United States Patent [19]

Weinberger

[11] 4,390,466

[45] Jun. 28, 1983

[54] HEAVY DUTY LIQUID DETERGENT

[76] Inventor: Harold Weinberger, 309 Johnson Ave., Teaneck, N.J. 07666

[21] Appl. No.: 258,887

[22] Filed: Apr. 30, 1981

[51] Int. Cl.[3] ..... C11D 3/32; C11D 3/43; C11D 1/70

[52] U.S. Cl. ..... 252/548; 252/DIG. 14; 252/173; 252/153; 252/559; 252/174.21; 252/174.22; 8/139.1; 564/224

[58] Field of Search ..... 252/548, 153, 559, 173, 252/174.22, 174.21, DIG. 5, DIG. 14; 8/139.1; 564/224

[56] References Cited

U.S. PATENT DOCUMENTS

| | | | |
|---|---|---|---|
| 1,990,453 | 2/1935 | Hund et al. | 564/224 |
| 2,170,845 | 8/1939 | Woodhouse | 564/224 |
| 2,768,957 | 10/1956 | Sullivan | 252/153 |
| 2,870,091 | 1/1959 | Tomlinson | 252/548 |
| 3,929,680 | 12/1975 | Arai et al. | 252/DIG. 14 |
| 3,953,382 | 4/1976 | Nelson | 252/548 |
| 4,233,174 | 11/1980 | Sheridan | 252/DIG. 14 |
| 4,284,532 | 8/1981 | Leikhim et al. | 252/DIG. 14 |

*Primary Examiner*—John E. Kittle
*Assistant Examiner*—Hoa Van Le
*Attorney, Agent, or Firm*—Duffield & Lehrer

[57] ABSTRACT

Novel aqueous liquid detergents having superior soil penetration, dissolving and suspending properties comprising a lower alkanolacetamide and/or a liquid hydrocarbon such as an isoparaffinic hydrocarbon. The detergents may be used in laundering natural or synthetic fabrics or general purpose cleaning.

24 Claims, No Drawings

HEAVY DUTY LIQUID DETERGENT

BACKGROUND OF THE INVENTION

The present invention relates to detergent compositions and more particularly to heavy duty liquid detergent compositions for laundering, stain and spot removal and general purpose cleaning.

In recent years heavy duty liquid detergent compositions have become very popular for home laundry use, industrial uses, and in diluted form for hand dishwashing. These compositions offer many advantages over powdered detergent products such as ease of use, no dust or caking, no spillage from torn packages, etc. Generally, heavy duty liquid detergents contain anionic and non-ionic surface-active agents, phosphates and polyphosphates, soil suspending and dispersing agents, optical brighteners, colorants and perfume. The surface-active agents, which furnish the detergent action, are generally of the linear alkylaryl sulfonate type (anionic), and mono- and dialkanolamides of long chain fatty acids (non-ionic). Phosphates and polyphosphates are added as effective and efficient soil-suspending agents and to disperse the soil to mitigate against its redeposition on the washed fabrics. Since phosphates are alkaline and corrosive to aluminum parts in washing machines, alkali metal silicates are added as corrosion inhibitors to minimize the corrosive effect of phosphates.

Recently, however, the use of phosphates and polyphosphates in detergent compositions has been discouraged and even banned in many areas for ecological considerations. Non-phosphate-containing detergents are available, but these contain inorganic substances such as sodium carbonate and sodium sulfate as phosphate replacements. They may also present ecological hazards and in addition their detergency is usually less than phosphate-containing compositions.

Another problem associated with detergent compositions containing inorganic salts is that a precise balance of ingredients must be effected to achieve stability on long standing or at low temperatures.

In recent years a new class of non-ionic surface-active agents has been made available for use in liquid detergent compositions. To a great extent they have replaced the alkanolamides of long chain fatty acids as the non-ionic component of detergents. These products are synthetic alcohols with carbon chain lengths of 12–15, which are then reacted with ethylene oxide to produce so-called ethoxylated alcohols containing from 3 to 12 moles of ethylene oxide per mole of alcohol. These products are low-foaming with good water solubility and have excellent detergent properties. They lend themselves well to the formulation of non-phosphate detergents, although they are equally useful in phosphate-containing compositions.

However, even the most efficient current commercial heavy duty liquid laundry detergents lack the ability to remove completely or substantially completely certain types of soil from cotton or cotton-synthetic blend fabrics and to substantially prevent some soil redeposition in the washed fabric, despite the addition of soil-suspending agents to the composition. The most common type of soil found on wearing apparel is sebaceous soil, which arises from the secretion of natural oily ingredients from the skin. This soil is particularly adherent to cotton and cotton blends and is difficult to remove during the laundering cycle. Many compositions have been offered as pre-treatments before laundering, but none has proved substantially successful.

DESCRIPTION OF THE PREFERRED EMBODIMENTS

The basis of the present invention lies in the finding that the inclusion of one or more components to a typical heavy duty detergent imparts many benefits not currently found. Excellent soil penetrating, dissolving and suspending characteristics are obtained according to the invention by the use of a lower alkanolacetamide. Further, excellent results are obtained by the use of a liquid hydrocarbon, both of these non-ionic materials being described hereinafter. Other components of the detergent composition may include a polyethoxylated alkylphenol, a (higher alkyl) aryl sulfonate, a polyethoxylated higher alkanol and a lower alkylbenzene sulfonate hydrotrope. Additionally, water and a lower alkanol such as ethanol may be present.

The lower alkanolacetamide component preferably has the formula HO—R—$NHCOCH_3$ wherein R is lower alkylene, more preferably a straight or branched alkylene of about 2 to 4 carbons such as ethylene, propylene and butylene. Thus, the lower alkanol portion may be ethanol, n-propanol, iso-propanol, n-butanol and iso-butanol. The alkanolacetamide component may be obtained commercially or synthesized by methods known in the art such as the reaction of an alkanolamine with acetic acid or a derivative thereof such as acetic anhydride or acetyl chloride. As with the other components used in the present invention, the lower alkanolacetamide may be a single compound or a mixture of discrete chemical entities coming within the component definition. The lower alkanolacetamide may be used as an aqueous solution such as the Schercomid AME-70 material available from Scher Chemicals, Inc. of Clifton, N.J. which is a 70% N-acetyl monoethanolamine solution in water. Preferably, the lower alkanolacetamide is a mono (lower alkanol) acetamide, is water-soluble and is low-foaming. Preferably, the OH is not on the alkylene carbon attached to the nitrogen.

The liquid hydrocarbon component of the invention is preferably an isoparaffinic hydrocarbon, such materials being available commercially as products of petroleum refining. Examples of isoparaffinic hydrocarbons are the Isopar solvents of the Exxon Company, U.S.A. of Houston, Tex. and the Soltrol solvents of Phillips Petroleum Co. of Bartlesville, Okla. Preferred isoparaffinic hydrocarbons are liquids with boiling points of at least 100° C., more preferably at least about 200° C., e.g. about 200° to 300° C. with average molecular weights of about 190 to 200. Although the exact characteristics of a particular commercial grade of an isoparaffinic hydrocarbon for use in the invention may vary, e.g. among batches of the C, E, G, H, K, L or M grades of Isopar, the isoparaffinic hydrocarbons may be described as acyclic, aliphatic branched chain hydrocarbon mixtures with total saturates of about 99 volume % or greater and total aromatics of about 1 volume % or less.

The polyethoxylated alkylphenol component preferably is ethoxylated to the extent of about 8 to 12 moles of ethylene oxide, although it should be understood that as with other components of the invention, commercially available materials will be mixtures containing molecules outside of this range. The alkyl portion of the polyethoxylated alkylphenol preferably has about 6 to 10 carbons, more particularly 8 or 9 carbons. Such polyethoxylated alkylphenols are available commercially under the trademark Triton from the Rohm and Haas Co. of Philadelphia, Pennsylvania, e.g. Triton X-100 and Triton X-114, and under the trademark Tergitol from Union Carbide Corp. of New York, N.Y., e.g. Tergitol NP-14 and Tergitol NP-27. Preferably, the polyethoxylated alkylphenol has both water and oil solubility and is low-foaming with superior wetting and detergent properties. Other polyethoxylated alkylphenols which can be used are those sold under the Alkasurf trademark by Alkaril Chemicals Ltd. of Mississauga, Ontario, e.g. Alkasurf OP-8 and Alkasurf OP-10.

The (higher alkyl) aryl sulfonate component of the invention generally has a branched or linear alkyl chain of about 12 to 15 carbons attached to an aryl group such as benzene or toluene. This alkylaryl molecule is then sulfonated and converted to a salt such as the sodium, potassium or triethanolamine salt to yield the (higher alkyl) aryl sulfonate component. Such materials are available commercially for use in detergents under trademarks such as Sulframin and Witconate from Witco Chemical Corp. of New York, N.Y.

The polyethoxylated higher alkanol component of the invention generally has a higher alkanol portion of about 9 to 15 carbons and an ethoxylation range of about 6 to 12 moles of ethylene oxide. Such polyethoxylated higher alkanols are available commercially for use in detergents under trademarks such as Neodol from Shell Chemical Co. of Houston, Texas, e.g. Neodol 25-7, Neodol 25-9 and Neodol 25-12 which are $C_{12}$–$C_{15}$ primary linear alcohol ethoxylates containing 7, 9 and 12 moles, respectively, of ethylene oxide and Neodol 91-6 which is a $C_9$–$C_{11}$ primary linear alcohol ethoxylate containing 6 moles of ethylene oxide, and Tergitol from Union Carbide Corp. of New York, New York, e.g. Tergitol 25-L-7.

The lower alkylbenzene sulfonate component of the invention generally is a salt such as an alkali metal or ammonium salt, e.g. sodium or potassium. The lower alkylbenzene portion is, for example, xylene, toluene or cumene. This component of the invention may be described as a hydrotrope which can be defined as a material which has the ability to suspend and hold in solution soils that are not normally water-soluble and which might otherwise redeposit on a laundered fabric. As with other components used in the invention, lower alkylbenzene sulfonates are available commercially as water solutions or suspensions with a certain percentage of active ingredient by weight. Such lower alkylbenzene sulfonates are available commercially under trademarks such as the various Naxonates from Nease Chemical Co. of State College, Pa.

Other components which may be used in the liquid detergent composition of the invention include an alcohol such as ethanol, fragrance or a coloring material in addition to other ingredients known for use in the detergent art. The detergent composition may be obtained by preparing a mixture of the ingredients and carefully stirring until a clear, homogeneous solution is obtained. If necessary, the mixture may be warmed slightly during stirring.

The various components which may be present in the liquid detergent composition of the invention may be used in the following percentages by weight, with the remainder being water, alcohol, fragrance, coloring or other standard additives: about 2 to 8% lower alkanolacetamide (70% active), preferably about 2 to 5%; about 2 to 5% liquid hydrocarbon, preferably about 3 to 5%; about 1 to 6% polyethoxylated alkylphenol, preferably about 2%; about 10 to 40% (higher alkyl) aryl sulfonate (60% active), preferably about 10 to 30%, most preferably about 20 to 25%; about 10 to 30% polyethoxylated higher alcohol, preferably about 20 to 30%, most preferably about 20%; and about 2 to 10% lower alkylbenzene sulfonate hydrotrope (40% active), preferably about 5%.

By the addition of the lower alkanolacetamide and/or liquid hydrocarbon components of the invention to a liquid detergent composition as explained above, it is possible to formulate superior detergent compositions containing no phosphates, alkali or alkaline salts or sodium silicates. Further, the detergent compositions of the invention do not separate on standing or turn cloudy after one week at 4.5° C. Additionally, the compositions of the invention permit less soil redeposition without the use of special soil-suspending agents, which agents generally do not add to the detergency of the composition. Even without the addition of an optical brightener, commonly used to impart "whiteness" to washed fabrics, the compositions of the invention give superior whiteness by the test procedure described below.

The liquid detergent of the invention may be used as a replacement for standard detergents which are available commercially. Fabrics specifically treated with the detergent for stain removal need not be rinsed but may be added to a load of laundry in the washer. Generally, the detergent of the invention may be used in an amount of less than about 2 oz. to about 4 oz. per load of laundry. Additionally, it has been found that the detergent composition of the invention at a level of about 1 to 5% in water gives a solution which is an effective hard surface cleaner, for example, on ceramic tile, metal, painted surfaces, vinyl and glass. The composition of the invention is not injurious to such hard surfaces and, unlike commercial spray-type hard surface cleaners, it is not alkaline and its use need not be limited to specific hard surfaces.

EXAMPLES 1–5

The following components are mixed in the order and amounts in parts by weight given below and stirred, warming slightly if necessary until a clear homogeneous solution is obtained. Care is taken not to beat too much air into the mixture while stirring.

| | EXAMPLE NO. | | | | |
|---|---|---|---|---|---|
| | 1 | 2 | 3 | 4 | 5 |
| A. Water | 29.0 | 35.0 | 34.0 | 34.0 | 39.0 |
| B. Ethanol (95%) | 5.0 | 5.0 | 5.0 | 5.0 | 5.0 |
| C. Isoparaffinic Hydrocarbon (Isopar M) | 3.0 | 3.0 | 3.0 | 3.0 | 3.0 |
| D. (Linear Higher Alkyl) Aryl Sulfonate (60% Active) (Sulframin) | 25.0 | 25.0 | 25.0 | 20.0 | 25.0 |
| E. 7-Mole Ethoxylated $C_{12}$ to $C_{15}$ Alcohol (Neodol 25-7) | 30.0 | 25.0 | 25.0 | 30.0 | 20.0 |
| F. Sodium Xylene Sulfonate (40% Active) | 5.0 | 5.0 | 5.0 | 5.0 | 5.0 |
| G. Monoethanolacetamide (70% Active) (Schercomid AME-70) | 3.0 | 2.0 | 3.0 | 3.0 | 3.0 |

In Example 1 only, the triethanolamine salt of the linear alkylaryl sulfonate was used. In all other examples the sodium salt was used. All of the compositions were clear and stable. These compositions were evaluated for screening purposes by a modification of the usually accepted testing procedure. A solution containing 1 gram of detergent was dissolved in 1 liter of tap water to give a 0.1% solution. This solution was heated to 50° C. and swatches of soiled cotton and cotton/-polyester blend (using standard test soil) were placed in the solution and agitated for five minutes. The detergent solution was then poured off and 1 liter of tap water heated to 50° C. was added as a rinse. After another five minutes of agitation the rinse water was discarded and a second rinse cycle used. The cloths were then dried and compared visually with unwashed samples, and with samples similarly washed in a leading commercial detergent. In all cases our composition removed substantial amounts of soil, equal to or surpassing the comparison detergent. There was no visible soil redeposition.

Based on these qualitative results the composition of Example 5 was submitted to an independent testing laboratory for quantitative evaluation. Soil removal and redeposition properties of heavy duty liquid laundry detergents, including the composition of this invention, are determined as follows. Using an accepted technique soiled cloths are washed in a Terg-O-Tometer, a small-scale multiple unit washing machine which simulates the action of a home laundry unit. Swatches of standard soiled cloths are washed in the machine to determine soil removal and the soil redeposition index at selected water temperatures, water hardness and concentration of detergent. The reflectance of the soiled test cloths is measured before and after washing, using a Photovolt Reflectometer Model 675 equipped with a green filter. The difference in these readings gives a measure of detergent efficiency. To determine soil redeposition index, unsoiled cloths are included in the wash load and reflectance measurements of these and the washed soiled cloths measure the ability of the detergent to retain removed soil in suspension.

The tests were run on cotton and cotton-polyester blend with a permanent press finish. Separate pieces were coated with a standard clay-type soil and with sebaceous soil, using the composition of this invention and a leading commercial liquid detergent for comparison. Water temperature was 50° C., water hardness was 150 ppm and sample concentration was 0.15%.

| | % SOIL REMOVAL | |
|---|---|---|
| | Test Composition | Commercial Detergent |
| Cotton-Polyester (Clay Soil) | 15.5 | 15.5 |
| Cotton (Clay Soil) | 8.6 | 8.6 |
| Cotton-Polyester (Sebaceous Soil) | 26.4 | 20.5 |
| Cotton (Sebaceous Soil) | 18.7 | 12.5 |
| | REDEPOSITION INDEX | |
| | Test Composition | Commercial Detergent |
| Cotton-Polyester (Clay Soil) | 92.9 | 90.5 |
| Cotton (Clay Soil) | 94.0 | 89.3 |

The higher the redeposition index, the more efficient is the detergent in preventing suspended soil for redepositing on the laundered cloth.

EXAMPLE 6

Example 5 is repeated substituting 2.0 parts by weight of 8 mole ethoxylated octylphenol (Triton X-114 from Rohm and Haas Co.) for 2.0 parts by weight of water. The polyethoxylated alkylphenol is a low-foaming material with excellent wetting and detergent properties which imparts extra soil-suspending characteristics to the composition of Example 5.

An unexpected benefit arising from the use of our preferred detergent compositions 5 and 6 was noted during our investigation. We found that ball point ink used to mark the test cloths was considerably lighter in color after laundering.

Using unsoiled cotton/polyester and cotton cloths, ball point ink was applied in lines and allowed to dry for fifteen minutes. Each mark was then covered with a small amount of our composition which was allowed to remain for twenty minutes before it was thoroughly rinsed and dried. All of the ink stain was removed from the cotton blend and virtually all from the cotton cloth. In similar tests using fresh and dried blood stains, the stains were completely removed. A series of tests, performed by the same method on the same types of unsoiled cloths, was made using six different ball point inks, lipstick, black and brown shoe polish, mustard, chocolate syrup, tomato juice, chili sauce, plum jelly, coffee, tea and soy sauce. All but one of the ball point inks were completely removed, lipstick and black shoe polish were substantially removed. When our composition was allowed to remain on the stains for about twelve hours, all of the ball point ink was removed, as was most of the lipstick and black shoe polish.

The tests were repeated using the leading spray spot remover which contains aliphatic and chlorinated hydrocarbons and talc. In all cases these stains were either not removed at all or removed incompletely.

The present invention may be embodied in other specific forms without departing from the spirit or essential attributes thereof and accordingly, reference should be made to the appended claims rather than to the foregoing specification as indicating the scope of the invention.

I claim:

1. An aqueous liquid detergent composition with improved penetrating, dissolving and suspending characteristics comprising about 2 to 8% by weight, 70% active, of a lower alkanolacetamide and about 2 to 5% by weight of a liquid isoparaffinic hydrocarbon.

2. The detergent composition of claim 1, wherein the lower alkanol of said lower alkanolacetamide is selected from the group consisting of ethanol, propanol or butanol.

3. The detergent composition of claim 2, wherein said lower alkanolacetamide is monoethanol acetamide of the formula $HOCH_2CH_2NHCOCH_3$.

4. The detergent composition of claim 1, said composition further comprising about 1 to 6% by weight of a polyethoxylated alkylphenol.

5. The detergent composition of claim 1, said composition further comprising about 10 to 40% by weight, 60% active, of a (higher alkyl) aryl sulfonate.

6. The detergent composition of claim 1, said composition further comprising about 10 to 30% by weight of a polyethoxylated higher alkanol.

7. The detergent composition of claim 1, said composition further comprising about 2 to 10% by weight, 40% active, of a lower alkylbenzene sulfonate hydrotrope.

8. The detergent composition of claim 1, said composition comprising:

(i) About 2 to 8% by weight, 70% active, of a lower alkanolacetamide;

(ii) About 2 to 5% by weight of a liquid isoparaffinic hydrocarbon;

(iii) About 10 to 40% by weight, 60% active, of a (higher alkyl) aryl sulfonate;

(iv) About 10 to 30% by weight of a polyethoxylated higher alkanol; and (v) About 2 to 10% by weight, 40% active, of a lower alkylbenzene sulfonate hydrotrope.

9. The detergent composition of claim 8, further comprising:

(vi) About 1 to 6% by weight of a polyethoxylated alkylphenol.

10. The detergent composition of claim 1, said composition comprising:

(i) About 2 to 8% by weight, 70% active, of a lower alkanolacetamide of the formula HO-R-$NHCOCH_3$ wherein R is alkylene of about 2 to 4 carbons;

(ii) About 2 to 5% by weight of a liquid isoparaffinic hydrocarbon;

(iii) About 10 to 40% by weight, 60% active, of a (higher alkyl) aryl sulfonate having a higher alkyl group of about 12 to 15 carbons;

(iv) About 10 to 30% by weight of a polyethoxylated about $C_9$ to $C_{15}$ alkanol having an ethoxylation range of about 6 to 12 moles of ethylene oxide; and (v) About 2 to 10% by weight, 40% active, of a lower alkylbenzene sulfonate hydrotrope wherein the lower alkylbenzene is selected from the group consisting of toluene, xylene or cumene.

11. The detergent composition of claim 10, further comprising:

(vi) About 1 to 6% by weight of a polyethoxylated alkylphenol having an ethoxylation range of about 8 to 12 moles of ethylene oxide.

12. A method of suspending and removing foreign material from a surface comprising applying to the surface an aqueous liquid detergent composition with improved penetrating, dissolving and suspending characteristics comprising about 2 to 8% by weight, 70% active, of a lower alkanolacetamide and about 2 to 5% by weight of a liquid hydrocarbon.

13. The method of claim 12, wherein said foreign material comprises sebaceous soil and said surface is a fabric comprising cotton fiber.

14. The method of claim 12, wherein the lower alkanol of said lower alkanolacetamide is selected from the group consisting of ethanol, propanol or butanol.

15. The method of claim 14, wherein said lower alkanolacetamide is monoethanol acetamide of the formula $HOCH_2CH_2NHCOCH_3$.

16. The method of claim 12, wherein said liquid hydrocarbon is an isoparaffinic hydrocarbon.

17. The method of claim 12, said composition further comprising about 1 to 6% by weight of a polyethoxylated alkylphenol.

18. The method of claim 12, said composition further comprising about 10 to 40% by weight, 60% active, of a (higher alkyl) aryl sulfonate.

19. The method of claim 12, said composition further comprising about 10 to 30% by weight of a polyethoxylated higher alkanol.

20. The method of claim 12, said composition further comprising about 2 to 10% by weight, 40% active, of a lower alkylbenzene sulfonate hydrotrope.

21. The method of claim 12, said composition comprising:

(i) About 2 to 8% by weight, 70% active, of a lower alkanolacetamide;

(ii) About 2 to 5% by weight of a liquid hydrocarbon;

(iii) About 10 to 40% by weight, 60% active, of a (higher alkyl) aryl sulfonate;

(iv) About 10 to 30% by weight of a polyethoxylated higher alkanol; and (v) About 2 to 10% by weight, 40% active, of a lower alkylbenzene sulfonate hydrotrope.

22. The method of claim 21, said composition further comprising:

(vi) About 1 to 6% by weight of a polyethoxylated alkylphenol.

23. The method of claim 12, said composition comprising:

(i) About 2 to 8% by weight, 70% active, of a lower alkanolacetamide of the formula HO-R-$NHCOCH_3$ wherein R is alkylene of about 2 to 4 carbons;

(ii) About 2 to 5% by weight of a liquid isoparaffinic hydrocarbon;

(iii) About 10 to 40% by weight, 60% active, of a (higher alkyl) aryl sulfonate having a higher alkyl group of about 12 to 15 carbons;

(iv) About 10 to 30% by weight of a polyethoxylated about $C_9$ to $C_{15}$ alkanol having an ethoxylation range of about 6 to 12 moles of ethylene oxide; and (v) About 2 to 10% by weight, 40% active, of a lower alkylbenzene sulfonate hydrotrope wherein the lower alkylbenzene is selected from the group consisting of toluene, xylene or cumene.

24. The method of claim 23 further comprising:

(vi) About 1 to 6% by weight of a polyethoxylated alkylphenol having an ethoxylation range of about 8 to 12 moles of ethylene oxide.

* * * * *